United States Patent [19]

Riggs et al.

[11] Patent Number: 4,576,811

[45] Date of Patent: Mar. 18, 1986

[54] PROCESS FOR ADJUSTING THE FIBER STRUCTURE OF MESOPHASE PITCH FIBERS

[75] Inventors: Dennis M. Riggs; Hugh E. Redick, both of Simpsonville, S.C.

[73] Assignee: E. I. Du Pont de Nemours and Company, Wilmington, Del.

[21] Appl. No.: 755,521

[22] Filed: Jul. 16, 1985

Related U.S. Application Data

[63] Continuation of Ser. No. 548,300, Nov. 3, 1983, abandoned.

[51] Int. Cl.[4] ..... D01D 5/00

[52] U.S. Cl. ..... 423/447.2; 264/29.2; 264/176 F; 425/72 S; 425/464

[58] Field of Search ..... 264/29.1, 29.2, 168, 264/176 F, 177 F; 425/72 S, 131.5, 376 R, 378 S, 461, 464; 423/447.2

[56] References Cited

U.S. PATENT DOCUMENTS

| | | | |
|---|---|---|---|
| 304,901 | 9/1884 | Bowron et al. | 264/29.2 |
| 3,817,680 | 6/1974 | Gultner et al. | 425/464 |
| 4,005,183 | 1/1977 | Singer | 264/29.2 |
| 4,376,747 | 3/1983 | Nazem | 264/29.2 |

FOREIGN PATENT DOCUMENTS

| | | | |
|---|---|---|---|
| 123451 | 10/1984 | European Pat. Off. | 264/29.2 |
| 3346257 | 9/1984 | Fed. Rep. of Germany | 264/29.2 |
| 212693 | 8/1984 | German Democratic Rep. | 264/75 |
| WO84/03722 | 9/1984 | PCT Int'l Appl. | 264/29.2 |

*Primary Examiner*—Jay H. Woo
*Assistant Examiner*—J. Fortenberry

[57] ABSTRACT

A spinnerette for mesophase pitch includes a spinnerette body with a plurality of mesophase pitch fiber forming channels through it. Each bore includes a capillary bore section at the outlet side of the spinnerette body, a wider diameter counter bore at the inlet side and an entrance between the wider bore and capillary bore sections with the entrance wall defining a relatively flat angle for increasing the proportion of tangential cross-section pitch fibers, as compared with radial cross-section fibers.

4 Claims, 5 Drawing Figures

PROCESS FOR ADJUSTING THE FIBER STRUCTURE OF MESOPHASE PITCH FIBERS

This application is a continuation of Ser. No. 548,300 filed Nov. 3, 1983, now abandoned.

BACKGROUND OF THE INVENTION

The present invention relates to a spinnerette for producing mesophase pitch fibers, and particularly to a spinnerette structure for controllably adjusting the fiber structure of the fiber produced.

Producing a carbon fiber from mesophase pitch includes passing mesophase pitch through a channel or bore in a spinnerette, thermosetting the resulting pitch fibers and then carbonizing the pitch fibers to produce carbon fibers.

Carbon fibers produced from mesophase pitch can have different cross-sectional structures which result from crystallite orientation within the fiber. The cross-sectional structure can be viewed under magnification. Such cross-sectional structures are either generally tangential, which is a multilayer annular array of crystals called an "onion skin" structure, or they are generally radial, or they may have a random structure which is neither one nor the other. It is known that a change in the cross-sectional structure of the fiber from more radial to more onion skin increases the tensile strength of the fibers. The carbon fiber cross-sectional structure is determined by the channel or bore through the spinnerette and that structure is preserved after the pitch fiber has been converted to the carbon fiber by carbonization.

The desirability of improving the characteristics of mesophase pitch fiber has been recognized previously, and one technique that has been used for selecting a particular cross-sectional structure for a mesophase pitch fiber is described in U.S. Pat. No. 4,376,747. In that patent, the cross-sectional structure of the carbon fibers is adjusted by positioning a porous body having certain specific properties in the spinnerette channel.

SUMMARY OF THE INVENTION

Accordingly, it is the primary object of the invention to increase the tensile strength of carbon fibers. It is a related object to change the cross-sectional structure of the fibers from radial to onion skin which inter alia increases the tensile strength.

It is a further object of the invention to achieve the change in cross-sectional structure of the pitch fiber by a controllable adjustment of the channel through the spinnerette.

A spinnerette includes a multi-bore die with the bores passing completely through the die and being arranged in a multi-row matrix. Each bore is a multisection channel, including a narrowed diameter capillary outlet section at the outlet side and a wider diameter section defined by a counter bore at the inlet side. The counter bore has a diameter which is in the range of about two times the capillary diameter to about ten times the capillary diameter, with the greater ratio between the counter bore diameter and the capillary diameter being preferred. Similarly, the ratio between the axial length of the capillary and the diameter of the capillary is in the range of the capillary length being twice the capillary diameter to the capillary length being eight times the capillary diameter, with that ratio preferably being four.

By adjusting the entrance angle in the wall of the bore from the wider counter bore to the narrower capillary of the bore the cross-sectional structures of the fibers are adjusted. It now has been discovered that the tensile strength of the carbon fibers increases as the entrance angle into the capillary increases. Further, scanning electron microscope photographs of carbon fiber cross-sections shows that their cross-sectional structures change from radial to onion skin as the entrance angle increases.

The entrance wall into the capillary is typically a tapering entrance, and the entrance angle is measured across an entire diameter of the entrance from one side to the other extended to the hypothetical apex at which the wall sides would intersect. Conventionally, the entrance wall may have a single angle between the wider entrance bore and the capillary outlet bore, or the entrance wall may have a compound angle, with a first portion of the wall from the wider bore section toward the capillary section having one angle and the second part of the wall through the remainder of the entrance to the capillary section having a different angle. The entrance wall angles of the bores of common melt spinning spinnerettes are conventionally 60° or are compound angles of 80/60 degrees or 110/90 degrees. It has been found, however, that the desired change in fiber cross-sectional structure from radial to onion skin occurs with spinnerette entrance angles in the range of 120 degrees to 170 degrees.

DESCRIPTION OF THE DRAWING FIGURES

Figure 3:
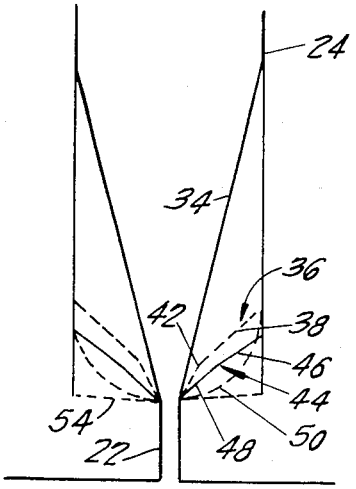
FIG. 3 is an enlarged schematic cross-sectional view of the capillary entrance region of the fiber producing bore showing a selection of entrance wall angles according to the prior art and according to the invention.
Figure 4:
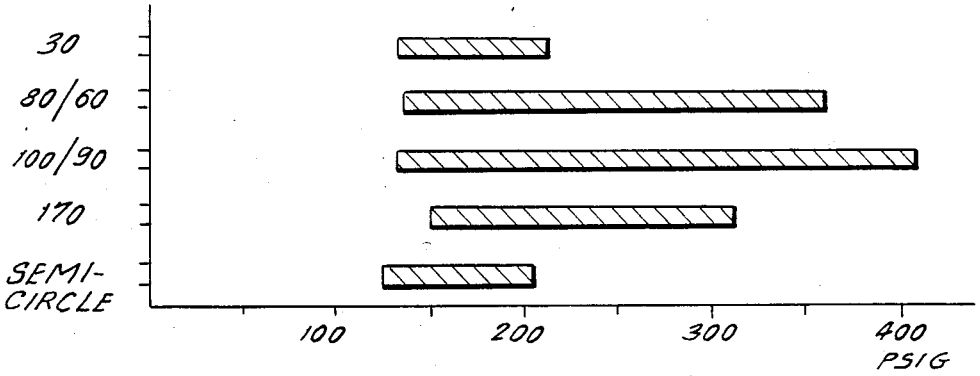
Figure 5:
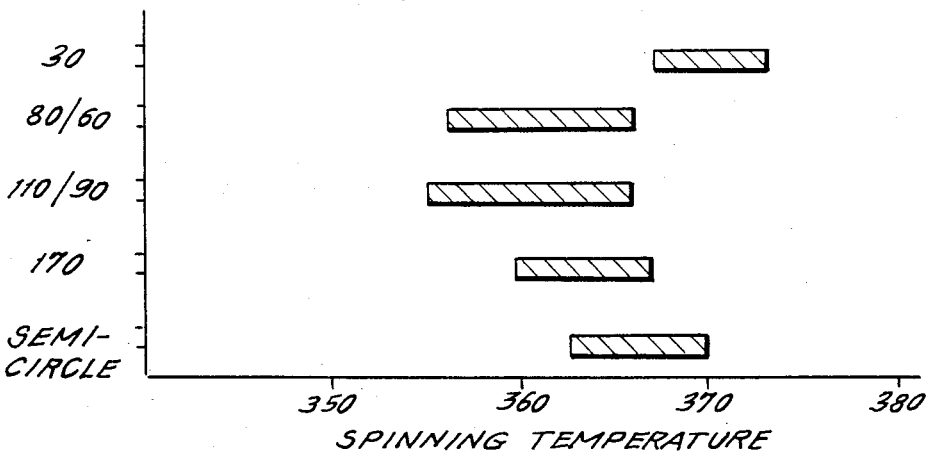

FIG. 4 graphically shows the entrance wall angles illustrated in FIG. 3 against pack pressure in psig; and FIG. 5 graphically shows the entrance angles against the spinning temperatures for the mesophase pitch being formed into fibers in the spinnerette.

DESCRIPTION OF THE PREFERRED EMBODIMENT

Figure 1:
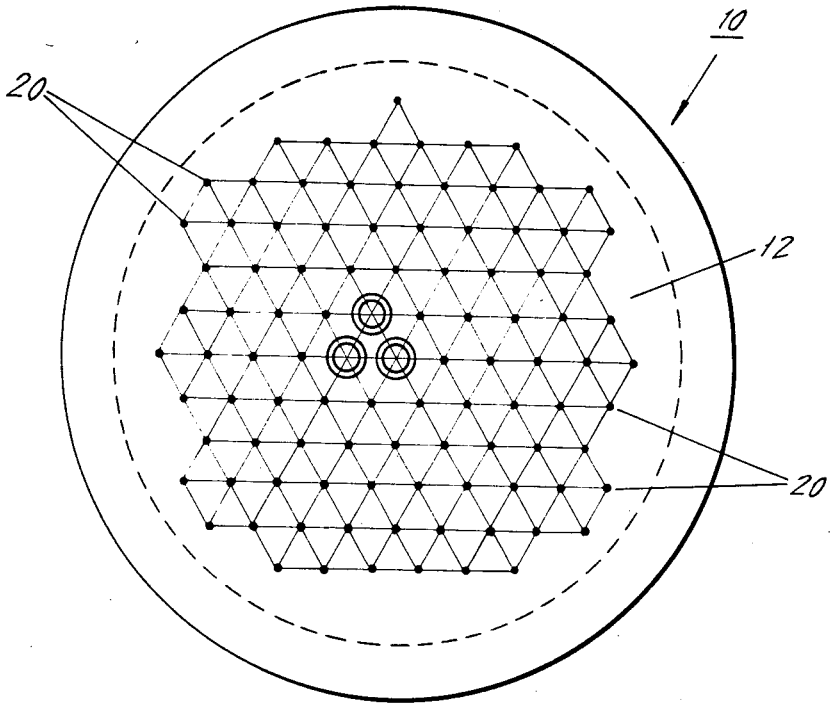
FIG. 1 is a top plan view of a spinnerette with a 100 hole 12 row array of bores, with a few of the bores shown and with the axial location of the remaining bores being illustrated.
Figure 2:
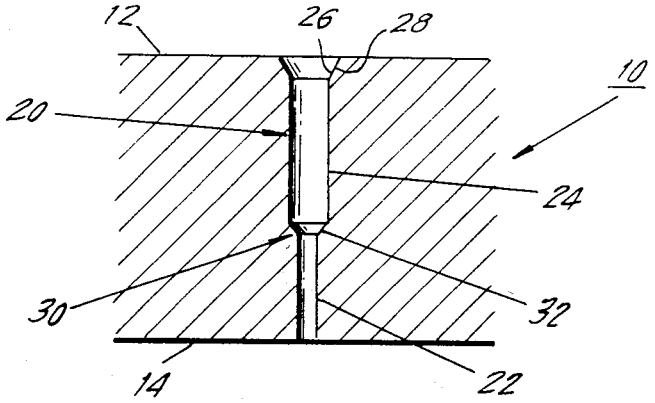
FIG. 2 is a cross-sectional view through the spinnerette showing one of the fiber forming bores.

Referring to FIGS. 1 and 2, a mesophase pitch fiber spinning apparatus (not shown) includes a spinnerette 10, which is a hard metal body which is relatively thin between its inside or inlet side 12 and its outlet side 14. The spinnerette body has a plurality of identical bores 20 passing through it. The bores in the body 10 of FIG. 1 are in an array of 100 bores, although the number and array of bores is not at the point of this invention. A view of the inlet end of a few of the bores at the center of the array is illustrated. All of the bores would have the same appearance. At the inlet side of the spinnerette body, means (not shown), e.g. a conventional piston arrangement, apply pressure to a supply of liquid mesophase pitch contained in a reservoir (not shown) above the inlet side, and the piston applies pack pressure in the range of 100–400 psig to the pitch for forcing it through all of the bores 20. The temperature in the pitch above the spinnerette body and in the spinnerette body is maintained at a conventional elevated spinning temperature, e.g. in the range of 350°-380° C., or at other appropriate temperatures. The body 10 may have included heating means or may be adjacent to heating means (not shown), as is also conventional.

Each bore 20 defines a spinnerette channel for producing a filament of mesophase pitch fiber. Subsequent to its formation, the pitch fibers are thermoset or oxidized and are thereafter carbonized by apparatus (not shown) in accordance with conventional practice.

The main length sections of the bore or spinnerette channel 20 are the outlet capillary bore 22 and the considerably wider counter bore 24 above the capillary. The upper counter bore has a wide entrance 26 which has a tapering neck 28 leading to the counter bore.

The capillary diameter may vary over a broad range between 0.15 mm. and 0.75 mm., with 0.20 mm. being a preferred diameter. The capillary has a length 0.80 mm. The counter bore diameter is typically about 2 mm. The length of the counter bore is not significant with respect to the invention. With these dimensions, the space between the centers of adjacent bores in the spinnerette body is about 4 mm.

The invention relates to the entrance 30 from the counter bore 24 of the channel to the capillary 22, and particularly is directed toward the entrance angle of the wall 32 defining that entrance. In FIG. 2, that angle is shown as 90 degrees, which is measured from an imaginary apex of the wall 32 and is measured in a plane containing a diameter of the wall 32 and its hypothetical apex. The illustrated angle in FIG. 2 is not a preferred angle for the entrance.

FIG. 3 shows a selection of mutually exclusive entrance angles, including prior art angles and angles according to the invention. In FIG. 3, the counter bore has a diameter of 2 mm., the capillary has a diameter of 0.20 mm. and the capillary has a length of 0.80 mm., giving it a length to diameter ratio of 4.

Obviously, a spinnerette bore would have only one of the entrance angles shown in FIG. 3 and in a typical spinnerette body, all of the spinnerette bores have the same entrance angle. In FIG. 3, the entrance wall 34 has an angle of 30 degrees. The entrance wall 36 is a compound wall having an upstream entrance section 38 with an entrance angle of 80 degrees, and the entrance section merges into a downstream exit section 42 with a smaller entrance angle of 60 degrees. The entrance wall 44 is also a compound wall, with an entrance section 46 with an angle of 110 degrees and with an exit section 48 with an angle of 90 degrees. The entrance walls 34, 36 and 44 have conventional entrance wall configuration angles for a spinnerette bore. Entrance wall 50 is an unusual concavely semicircular cross-section wall, which defines a concave hemispherical wall surface. This is an unusual shape for spinnerette bore entrance walls. Finally, the entrance wall 54 has an angle of 170 degrees, whereby it is nearly flat across.

As was noted above in the general description section of the invention, it has been found that an increase in tangential or onion skin pitch fiber cross-sections, which results in increased tensile strength, is accomplished by flattening the entrance angle, increasing the size of the angle. The wall 54 of the entrance is a more preferred angle than the other entrance angles shown in FIG. 3. The semi-circular or hemispherical entrance wall 50 also would be beneficial because in the vicinity of the capillary entrance, the semi-circular cross-section entrance wall is essentially flat or at 180 degrees. As was noted above, the benefits of tangential fiber cross-section and increased tensile strength are especially realized at entrance wall angles in the preferred range of 120 to 190 degrees.

FIGS. 4 and 5, respectively, plot pack pressure and spinning temperature against capillary entrance angle for the spinnerette bore entrance angles shown in FIG. 3, using the same composition mesophase pitch. Tests of tensile strength of the pitch fibers produced using capillaries with each of the illustrated entrance angles were tested in the following runs:

EXAMPLE 1

A petroleum pitch, Ashland 240, was converted into a carbon fiber feed material suitable for spinning by following the procedure of U.S. Pat. Nos. 4,277,324 and 4,283,269; both of these patents being incorporated herein by reference. More particularly, the petroleum pitch was mutually vacuum stripped to remove overhead low boiling impurities. The stripped pitch was then heat soaked at 395° C. for 2 hours.

The heat soaked, high mesophase pitch was next extracted with a solvent mixture comprising 83 parts toluene and 17 parts heptane. This extraction step was followed by a second extraction with heptane alone. The thus treated pitch feed was then pelletized at 404° C., which served as the feed to the spinnerette. The spinnerette feed had a glass transition temperature of 250° C., as predicted spinning temperature of 365° C., and when molten a viscosity of 630 poises.

The resultant carbon fiber feed pitch was tested in the apparatus shown in FIGS. 2 and 3 at various entrance angles and spinning temperatures. Ultimate tensile strength data obtained from the spun fibers in these tests are set forth below in Table A.

TABLE A

| Run and Entry Angle, Degrees | Spinning Temp., °C. High/Low | UTS, KSI Wet (Avg. of 4) | UTS, KSI Dry (Avg. of 2) |
|---|---|---|---|
| (1) 30 | 373/367 | 256/278 | 213/282 |
| (2) 80/60 | 366/356 | 296/298 | 323/306 |
| (3) 110/90 | 366/355 | 278/315 | 313/325 |
| (4) 170 | 367/360 | 316/367 | 337/341 |
| (5) Semi-Circular | 370/363 | 292/332 | 259/347 |

EXAMPLE 2

A separate batch of petroleum pitch Ashland 240, was subjected to the same treatment as set forth in Example 1, except pelletization was carried out at a temperature of 402° C. The spinnerette feed thus obtained had a glass transition temperature of 243° C., a predicted spinning temperature of 351° C., and when molten a viscosity of 630 poises.

The resultant carbon fiber feed was also tested in the apparatus shown in FIGS. 2 and 3 at various entrances angles and spinning temperatures in the same 100 hole spinnerette used in Example 1. Ultimate tensile strength data obtained from the spun fibers in these tests are set forth below in Table B:

TABLE B

| Run and Entry Angle, Degrees | Spinning Temp., °C. High/Low | UTS, KSI Wet (Avg. of 4) | UTS, KSI Dry (Avg. of 2) |
|---|---|---|---|
| (6) 30 | 359/358 | 212/227 | 160/167 |
| (7) 80/60 | 356/350 | 238/247 | 301/324 |

TABLE B-continued

| Run and Entry Angle, Degrees | Spinning Temp., °C. High/Low | UTS, KSI Wet (Avg. of 4) | UTS, KSI Dry (Avg. of 2) |
|---|---|---|---|
| (8) 170 | 362/358 | 296/334 | 277/326 |

The marked increase in tensile strength observed with the flatter entrance angles is a result of the fibers having a cross-section that is more tangential and onion skin, and less radial.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A process for producing carbon fiber from a mesophase pitch feed material which comprises passing said pitch feed material into a spinnerette body having an entrance side for the pitch feed material and having an exit side for the carbon fiber;

the spinnerette body having a spinnerette channel passing through it from the entrance side to the exit side; the channel comprising a capillary bore leading from within the body and opening out of the exit side thereof and having a capillary length to diameter ratio of from about 2:1 to 8:1; a larger diameter bore leading from the entrance side of the body toward the capillary bore and wherein the ratio of the diameter of the larger diameter bore to the diameter of the capillary bore is in the range between approximately 2:1 to 15:1; and a capillary bore entrance leading from the larger diameter bore into the capillary bore; the entrance being defined by a wall which narrows from the larger diameter bore to the capillary bore; the entrance wall having an entrance angle of from 120 to 170 degrees, which is measured diametrically across the entrance wall in a plane including a diameter of the entrance wall and the apex thereof, which is flat enough for giving the carbon fiber formed through the channel a greater proportion of tangential crossection of fibers.

2. The process of claim 1, wherein the spinnerette body has a plurality of the channels therethrough.

3. The process of claim 1, wherein the ratio of the diameter of the larger diameter bore to the diameter of the capillary bore is approximately 10:1.

4. The process of claim 1, wherein the capillary length to diameter ratio is about 4:1.

* * * * *